US007285012B2

(12) United States Patent
Wada et al.

(10) Patent No.: US 7,285,012 B2
(45) Date of Patent: Oct. 23, 2007

(54) WATERPROOF CONNECTOR

(75) Inventors: Yoshimi Wada, Shizuoka (JP); Toshinori Yamamoto, Shizuoka (JP); Shinichi Tsuchiya, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/585,089

(22) Filed: Oct. 24, 2006

(65) Prior Publication Data

US 2007/0099468 A1 May 3, 2007

(30) Foreign Application Priority Data

Oct. 27, 2005 (JP) ..... 2005-313103

(51) Int. Cl.
*H01R 13/40* (2006.01)

(52) U.S. Cl. ..... 439/587

(58) Field of Classification Search ..... 439/587, 439/589, 275, 274, 279
See application file for complete search history.

(56) References Cited

U.S. PATENT DOCUMENTS 3,941,444 A * 3/1976 Bruni et al. ..... 439/587
5,613,868 A * 3/1997 Ohsumi et al. ..... 439/275
5,679,019 A * 10/1997 Sakai et al. ..... 439/275
5,931,699 A * 8/1999 Saito ..... 439/587
D459,310 S * 6/2002 Tanaka ..... D13/147
6,554,631 B2 * 4/2003 Ishikawa et al. ..... 439/274
6,752,659 B2 * 6/2004 Nakamura et al. ..... 439/587
7,063,566 B2 * 6/2006 Tsuchiya et al. ..... 439/587

FOREIGN PATENT DOCUMENTS

JP 7-57815 3/1995
JP 2002-184508 6/2002

* cited by examiner

*Primary Examiner*—Briggitte R. Hammond
*Assistant Examiner*—Larisa Tsukerman
(74) *Attorney, Agent, or Firm*—Kratz, Quintos & Hanson, LLP

(57) ABSTRACT

The waterproof connector includes: a terminal having an electric wire; a housing body having a terminal insertion opening for inserting the terminal and a terminal receiving chamber for receiving the terminal; a waterproofing means having an electric wire insertion hole that is approximately coaxial with the terminal insertion opening of the housing body; and a rear holder which holds the waterproofing means and has a guide tube for guiding the terminal that is to be inserted into the terminal insertion opening, wherein a center axis of the guide tube is deviated from a center axis of the terminal insertion opening.

2 Claims, 4 Drawing Sheets

WATERPROOF CONNECTOR

BACKGROUND OF THE INVENTION (1) Field of the Invention

The present invention relates to a waterproof connector for use in electrical connection.

(2) Description of the Related Art

So far, a terminal having a bar-shaped tab has been used as a female connector for use in electrical connection.

FIG. 5 shows a partially enlarged cross sectional view illustrating an intermediate state when a terminal having an electric wire is being inserted into a connector housing of such a conventional female connector.

A female connector α includes a connector housing α1 and a terminal 1' to be inserted in the connector housing α1.

The connector housing α1 includes a housing body 2', waterproofing means 4', and rear holder 3' as its primary components.

The housing body 2' has a terminal insertion opening 2*a'* to let the terminal 1' having an electric wire pass therethrough and holds and receives the terminal 1' having an electric wire inserted through the terminal insertion opening 2*a'*.

The waterproofing means 4' is made of a soft material such as an elastomer, e.g. rubber to waterproof the circumference of the electric wire and includes an electric wire insertion hole 4*b'* which is approximately coaxial with a center axis of the terminal insertion opening 2*a'* of the housing body 2'.

The rear holder 3' holds the waterproofing means 4' and has a guide tube 3*a'* for guiding the terminal 1', which is to be inserted into the terminal insertion opening 2*a'*.

The terminal 1' includes: a bar-shaped tab 1*a'* for connecting the s terminal 1' to a female terminal in a mating connector (not shown in the figure) by being inserted in the female terminal in the mating connector when the female connector α is coupled with the mating connector, the tab 1*a'* being situated at an end of the terminal 1' in an insertion direction of the terminal 1' into the connector housing α1; an electric wire connecting part 1*b'* for connecting the terminal 1' to the electric wire; and a box part 1*c'* situated between the tab 1*a'* and the electric wire connecting part 1*b'*, wherein a center axis of the tab 1*a'* is not aligned with that of the box part 1*c'*.

The electric wire insertion hole 4*b'* of the waterproofing means 4' is approximately coaxial with the terminal insertion opening 2*a'* of the connector housing α1 and an inner diameter of the electric wire insertion hole 4*b'* is thinner than an outer diameter of the electric wire. Therefore, when the terminal 1' passes through the electric wire insertion hole 4*b'*, the terminal 1' presses and extends the electric wire insertion hole 4*b'* to pass therethrough.

However, since the center axis of the tab 1*a'* of the terminal 1' having an electric wire is not aligned with that of the box part 1*c'*, therefore as shown in FIG. 5 first an end of the bar-shaped tab 1*a'* of the terminal 1' abuts against a side surface of an electric wire sealing lip 4*a'*, which is formed on an inner surface of the electric wire insertion hole 4*b'* together with another electric wire sealing lip 4*a'*, then the terminal 1' presses and extends the electric wire insertion hole 4*b'* so as to pass through the electric wire insertion hole 4*b'* rubbing the side surface of the electric wire sealing lip 4*a'*.

Due to such a rub, the electric wire insertion hole 4*b'* might be damaged, causing insecurity in a waterproof structure formed between the electric wire sealing lip 4*a'* and a coating layer of the electric wire.

Thus, a terminal of the type described in Japanese Patent Application Laid-Open No. 2002-184508, in which a center axis of the tab is not aligned with that of the box part, is hardly applicable to a waterproof connector of the type described in Japanese Patent Application Laid-Open No. H07-057815.

SUMMARY OF THE INVENTION

It is therefore an objective of the present invention to solve the above problem and to provide a high quality waterproof connector without a necessity of change in design of the tab even if the waterproof connector is a connector of the type, in which a center axis of the tab of the terminal is not aligned with a center axis of the box part of the terminal.

In order to attain the above objective, the present invention is to provide a waterproof connector including:

a terminal having an electric wire;

a housing body having a terminal insertion opening for inserting the terminal and a terminal receiving chamber for receiving the terminal;

a waterproofing means having an electric wire insertion hole that is approximately coaxial with the terminal insertion opening of the housing body; and a rear holder which holds the waterproofing means and has a guide tube for guiding the terminal that is to be inserted into the terminal insertion opening, wherein a center axis of the guide tube is deviated from a center axis of the terminal insertion opening.

Preferably, the terminal includes: a tab for connecting the terminal to a female terminal in a mating connector by being inserted in the female terminal in the mating connector; and a box part situated on an electric wire fixing side of the tab, the tab being situated at an end part of the terminal in an insertion direction of the terminal into the housing body, wherein a center axis of the tab is out of alignment with a center axis of the box part in a plane perpendicular to the insertion direction of the terminal into the housing body.

According to a waterproof connector of the present invention, upon insertion of the terminal, the tab is prevented from damaging the periphery of the electric wire insertion hole, so that deterioration in a waterproof characteristic between the electric wire sealing lip and a surface of the electric wire can be prevented. That is, even as for a connector using a terminal, in which a deviation of the center axis of the tab from that of the box part is large, such as in a case in which a tab is formed by extending one surface of the box part, a high quality waterproof connector can be attained.

DESCRIPTION OF THE PREFERRED EMBODIMENTS

Figure 1A:
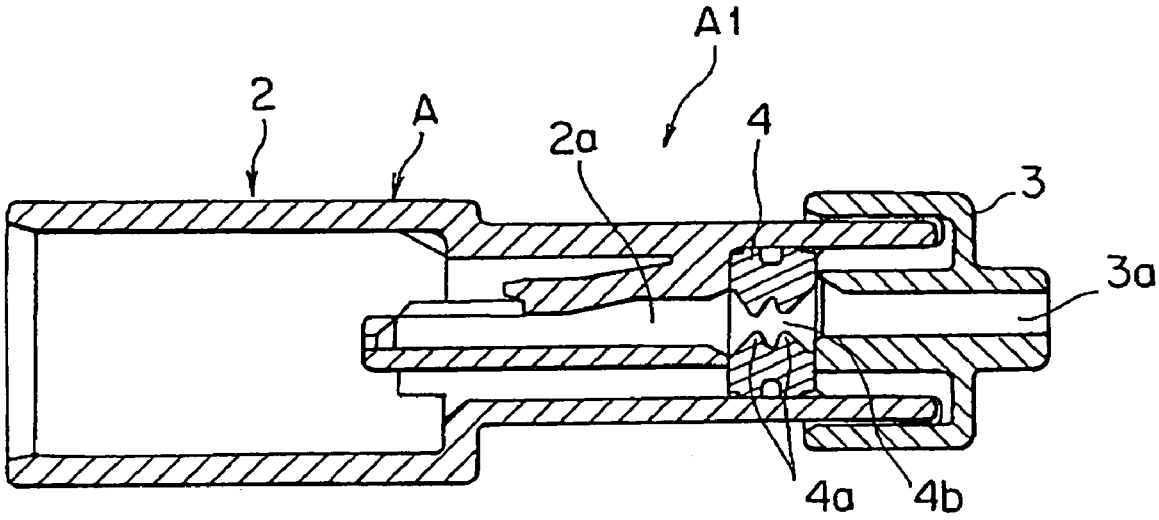
FIG. 1A is a cross sectional view illustrating a connector housing A1 constituting a waterproof connector (i.e. female connector) A according to the present invention.
Figure 1B:
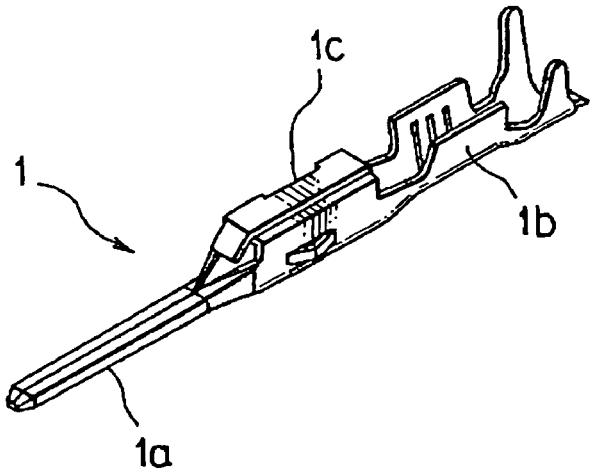
FIG. 1B is a perspective view of a terminal 1 (constituting the waterproof connector A according to the present invention together with the connector housing A1), which is used by being connected to an electric wire.

In the following, the preferred embodiments of the present invention will be explained with reference to the attached drawings. FIG. 1A is a cross sectional view illustrating a connector housing A1 constituting a waterproof connector (i.e. female connector) A according to the present invention. FIG. 1B is a perspective view of a terminal 1 which is used by being connected to an electric wire.

Figure 2A:
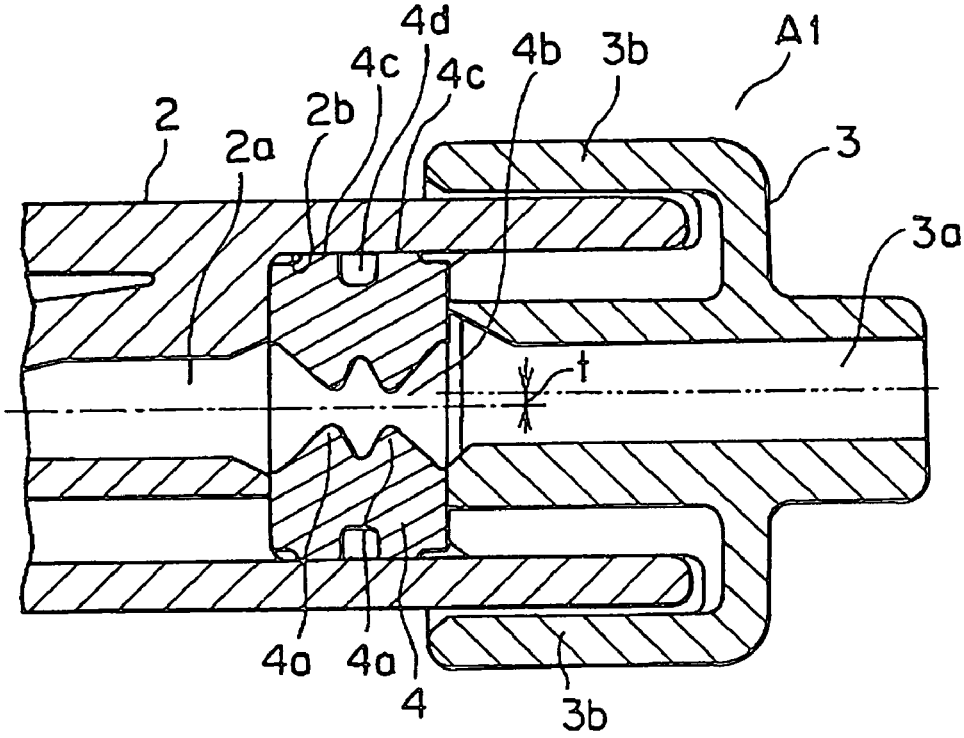
FIG. 2A is an enlarged cross sectional view around a one-piece rubber plug 4 of the connector housing A1.
Figure 2B:
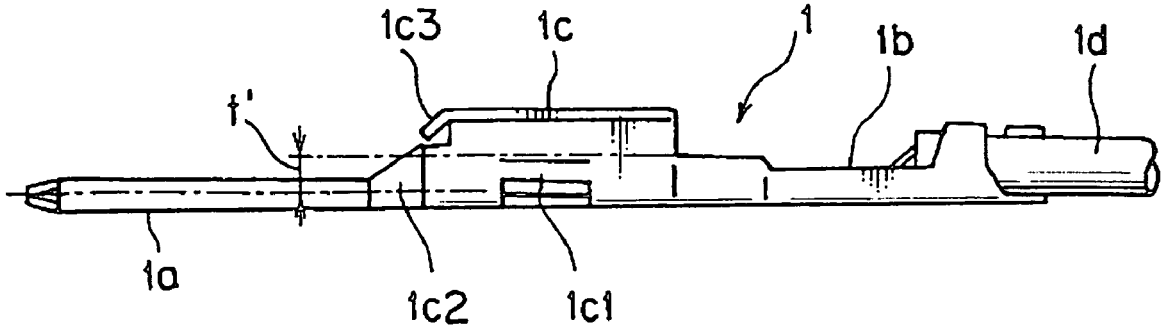
FIG. 2B is a side view of a terminal 1 connected to an electric wire 1*d;*

FIG. 2A is an enlarged cross sectional view around a one-piece rubber plug 4 which is a waterproofing means of the connector housing A1. FIG. 2B is a side view of a terminal 1 which is connected to an electric wire 1*d*.

The female connector A includes the connector housing A1 and the terminal 1 to be inserted into the connector housing A1.

The connector housing A1 includes a housing body 2, waterproofing means 4, and rear holder 3 as its primary components.

The housing body 2 has a terminal insertion opening 2*a* for inserting the terminal 1 having an electric wire and holds and receives the terminal 1 inserted through the terminal insertion opening 2*a*.

The waterproofing means 4 is made of a soft material such as an elastomer, e.g. rubber to waterproof the circumference of the electric wire 1*d* and includes an electric wire insertion hole 4*b* which is coaxial or approximately coaxial with a center axis of the terminal insertion opening 2*a* of the housing body 2. In this example, a one-piece rubber plug 4 made of rubber is used.

The rear holder 3 holds the one-piece rubber plug 4 and has a guide tube 3*a* for guiding the terminal 1 with an electric wire, which terminal 1 is to be inserted into the terminal insertion opening 2*a*.

The terminal 1 includes: a bar-shaped tab 1*a* for connecting the terminal 1 to a female terminal in a mating connector (not shown in the figure) by being inserted in the female terminal in the mating connector when the waterproof connector A is coupled with the mating connector, the tab 1*a* being situated at an end of the terminal 1 in an insertion direction of the terminal 1 into the connector housing A1; an electric wire connecting part 1*b* for connecting the terminal 1 to the electric wire 1*d*; and a box part 1*c* situated between the tab 1*a* and the electric wire connecting part 1*b*, wherein a center axis of the tab 1*a* is not aligned with the center axis of the box part 1*c*, that is, the center axis of the tab 1*a* is out of alignment with the center axis of the box part 1*c*. As shown in FIG. 2B, there is a distance t' between the two center axes.

As shown in FIG. 2A, the one-piece rubber plug 4 is held by the rear holder 3 having the guide tube 3*a* at a predetermined position in a receiving part 2*b* for receiving the one-piece rubber plug 4 in the housing body 2. The rear holder 3 includes a hood part 3*b* for covering the terminal insertion side-end of the housing body 2 and is fixed to the housing body 2 by a locking means (not shown in the figure).

An outer circumference (outer side surface) of the one-piece rubber plug 4 is provided with: two outer lips 4*c* each pressure-contacting with an inner wall of the tube-shaped receiving part 2*b* formed on the terminal-insertion side of the terminal insertion opening 2*a* of the housing body 2 in a watertight manner; and a groove part 4*d* formed between the two outer lips 4*c*. The outer lips 4*c* and the groove part 4*d* improve a sliding characteristic when the one-piece rubber plug 4 is slidingly set to a predetermined position (shown in the figure) of the receiving part 2*b*, enabling an easy setting to the predetermined position. Also, after the setting, a high watertight property is attained between the inner wall of the receiving part 2*b* and the one-piece rubber plug 4.

The electric wire insertion hole 4*b* communicates with the terminal insertion opening 2*a* and the guide tube 3*a* and is approximately coaxial with the terminal insertion opening 2*a* of the housing body 2.

A center axis (shown by an alternate long and short dash line in FIG. 2A) of a section of the terminal insertion opening 2*a* in a connecting direction of the terminal to a mating connector is not aligned with a center axis (shown by an alternate long and two short dashes line in FIG. 2A) of a section of the guide tube 3*a* in a connecting direction of the terminal to a mating connector. That is, as shown in FIG. 2A, there is a distance t between the two center axes.

Figure 3:
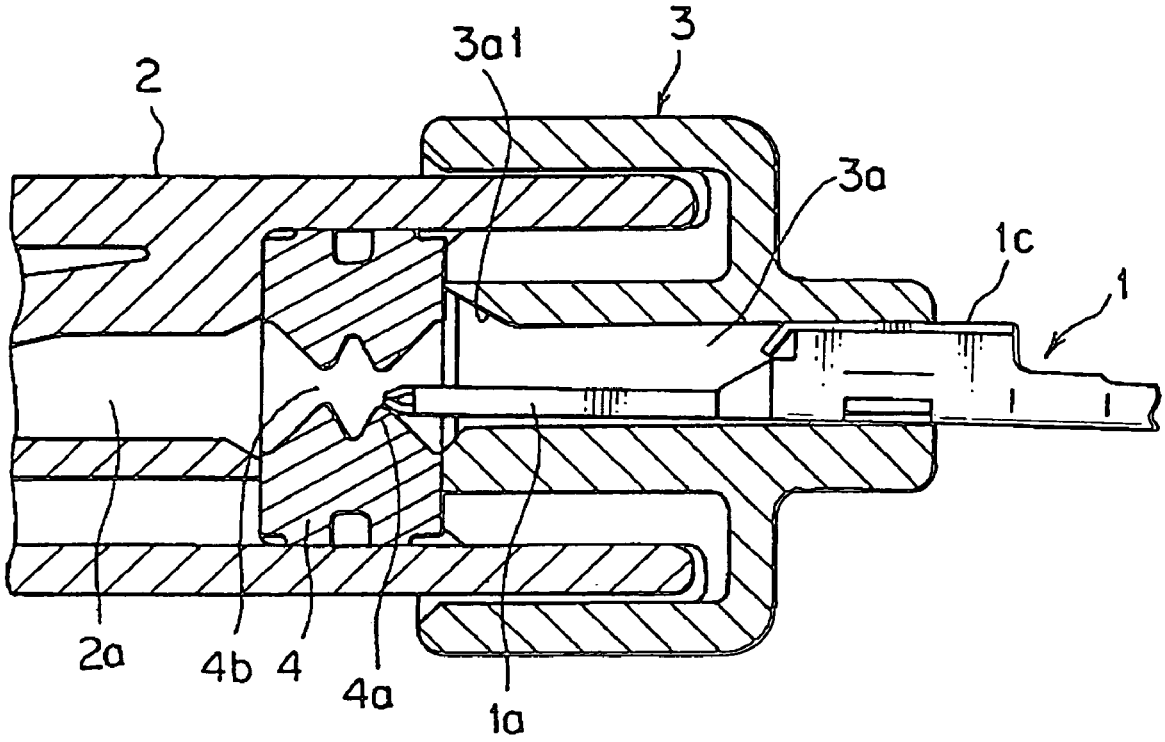
FIG. 3 is a cross sectional view illustrating an intermediate state when the terminal 1 having an electric wire is being inserted into a terminal insertion opening 2*a* of the connector housing A1.

FIG. 3 illustrates an intermediate state when the terminal 1 having an electric wire is being inserted into a terminal insertion opening 2*a* from the guide tube 3*a* of the connector housing A1.

FIG. 3 illustrates a state when an end part of the tab 1*a* of the terminal 1 enters in the electric wire insertion hole 4*b*.

Since an inner diameter of the electric wire insertion hole 4*b* is smaller than an outer diameter of the electric wire 1*d*, therefore when the terminal 1 passes through the electric wire insertion hole 4*b*, the terminal 1 extends the electric wire insertion hole 4*b* to pass therethrough.

As for the connector housing A1, within such an extent that an inner circumference of the guide tube 3*a* does not abut against an outer circumferential surface of the electric wire 1*d* being pulled out of the guide tube 3*a*, a center axis of the guide tube 3*a* is formed being deviated from that of the terminal insertion opening 2*a* with a deviation amount of t as shown in FIG. 2A. Therefore, the end part of the tab 1*a* is guided into the electric wire insertion hole 4*b* without abutting against the one-piece rubber plug 4 or, alternatively, even if the end part of the tab 1*a* abuts against the one-piece rubber plug 4, only very small friction takes place between the two, wherein the friction does not cause a problem since the one-piece rubber plug 4 is easily deformed so as to absorb the friction. Accordingly, the end part of the tab 1*a* is prevented from damaging a certain portion (i.e. inner wall) of one-piece rubber plug 4 and therefore, a good waterproof characteristic between a surface of the electric wire and the electric wire sealing lip 4*a* can be maintained.

Figure 4:
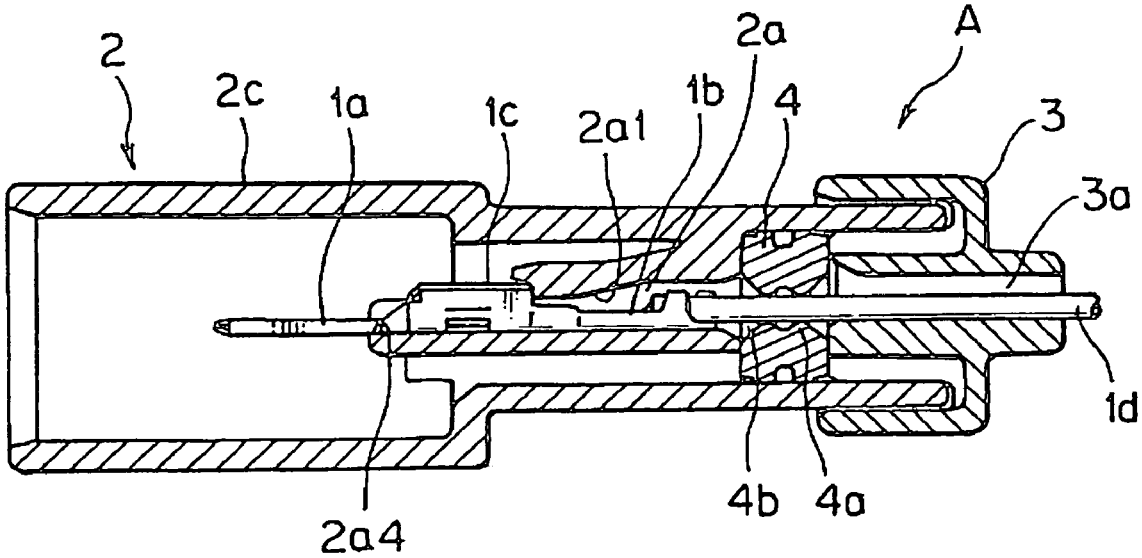
FIG. 4 is a cross sectional view illustrating a state when the terminal 1 having an electric wire is received in the terminal insertion opening 2*a* of the connector housing A1.
Figure 5:
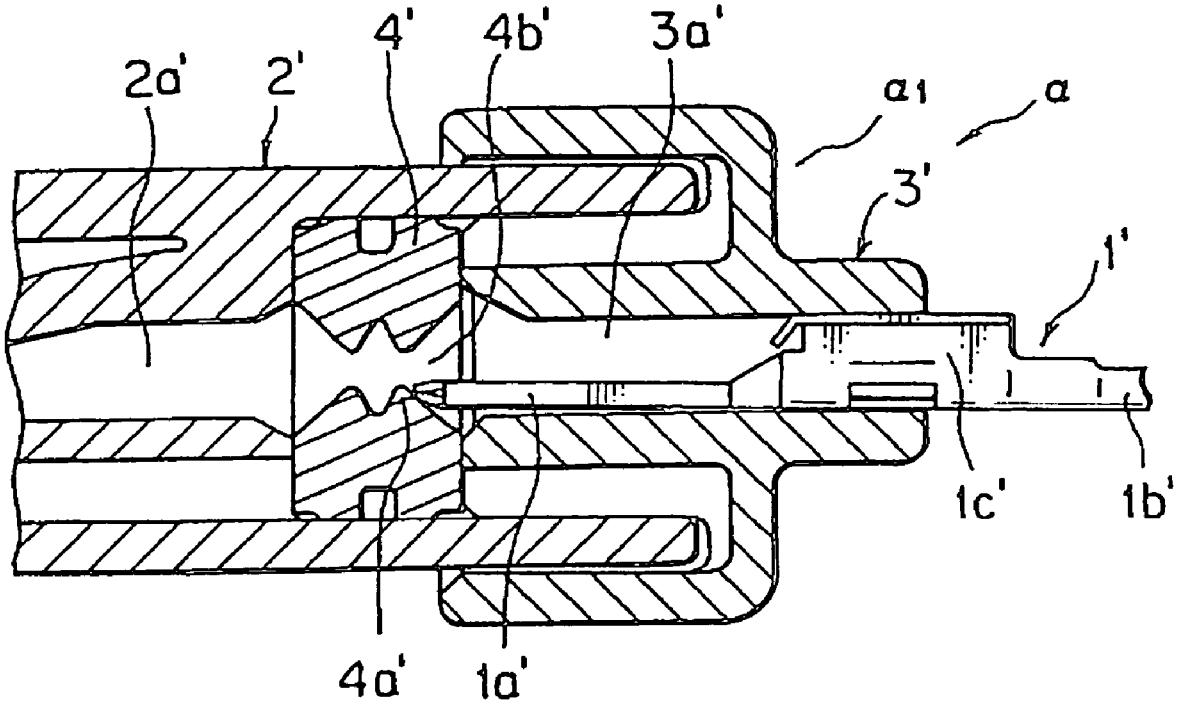
FIG. 5 PRIOR ART
FIG. 5 is a partially enlarged cross sectional view illustrating an intermediate state when a terminal having an electric wire is being inserted into a connector housing of a conventional female connector and a problem of such a conventional female connector.

FIG. 4 illustrates a state when the terminal 1 having an electric wire is received in the connector housing A1.

When the terminal 1 having an electric wire is received in a predetermined space in the connector housing A1, the two electric wire insertion lips 4*a* formed on the inner side surface of the electric wire insertion hole 4*b* pressure-contact with the circumference of the electric wire 1*d*, therefore a secure watertight characteristic can be attained.

In the waterproof connector A, the terminal 1 same as a terminal, which has been often used so far, can be used without a necessity of change in design thereof. The waterproof connector A according to the present invention, which includes the housing body 2, one-piece rubber plug 4 and rear holder 3 as its primary components, is easily made since it can be made only by changing a position where the guide tube 3*a* is formed in the rear holder 3.

In the above embodiment, an example of the waterproof connector A of the type in which one terminal is received inside is explained. However, the present invention can be applicable to a waterproof connector of the type in which a plurality of terminals are received inside, that is, the present invention includes such a waterproof connector as well.

The aforementioned preferred embodiments are described to aid in understanding the present invention and variations may be made by one skilled in the art without departing from the spirit and scope of the present invention.

What is claimed is:

1. A waterproof connector comprising:

a terminal having an electric wire;

a housing body having a terminal insertion opening for inserting the terminal and a terminal receiving chamber for receiving the terminal;

a waterproofing means having an electric wire insertion hole that is approximately coaxial with the terminal insertion opening of the housing body; and a rear holder which holds the waterproofing means and has a guide tube for guiding the terminal that is to be inserted into the terminal insertion opening, wherein a center axis of the guide tube is deviated from a center axis of the terminal insertion opening.

2. The waterproof connector according to claim 1, wherein the terminal includes: a tab for connecting the terminal to a female terminal in a mating connector by being inserted in the female terminal in the mating connector; and a box part situated on an electric wire fixing side of the tab, the tab being situated at an end part of the terminal in an insertion direction of the terminal into the housing body, wherein a center axis of the tab is out of alignment with a center axis of the box part in a plane perpendicular to the insertion direction of the terminal into the housing body.

* * * * *